United States Patent [19]

Kerr

[11] 4,095,550

[45] Jun. 20, 1978

[54] SELF-BURYING ANCHORING DEVICES

[75] Inventor: Neil Kerr, East Kilbride, Scotland

[73] Assignee: The Secretary of State for Industry in Her Britannic Majesty's Government of the United Kingdom of Great Britain and Northern Ireland, London, England

[21] Appl. No.: 786,935

[22] Filed: Apr. 12, 1977

[30] Foreign Application Priority Data

Apr. 21, 1976 United Kingdom ..... 16208/76

[51] Int. Cl.[2] ..... B63B 21/26

[52] U.S. Cl. ..... 114/295; 61/53.58; 61/53.74; 61/99

[58] Field of Search ..... 114/294–296; 61/53.5, 53.68, 53.74, 53.64, 53.58, 94, 98, 99

[56] References Cited

U.S. PATENT DOCUMENTS

| | | | |
|---|---|---|---|
| 3,344,612 | 10/1967 | Rininger | 61/99 |
| 3,965,687 | 6/1976 | Shaw | 61/99 |

FOREIGN PATENT DOCUMENTS

| | | | |
|---|---|---|---|
| 1,514,188 | 1/1968 | France | 114/295 |
| 2,513,534 | 3/1975 | Germany | 114/296 |
| 1,293,521 | 10/1972 | United Kingdom | 114/295 |

*Primary Examiner*—Trygve M. Blix
*Assistant Examiner*—Stuart M. Goldstein
*Attorney, Agent, or Firm*—Cushman, Darby & Cushman

[57] ABSTRACT

A self burying anchor of invert conical construction having an apex fluidizing water outlet and compressed air outlets close to the apex. The fluidizing water in conjunction with the compressed air, which expands in the confines of undisturbed bed material, bury the anchor beneath the fluidizing bed material. The anchor cone may be hollow and perforate so that fluidizing bed material is deposited inside to act as ballast.

8 Claims, 4 Drawing Figures

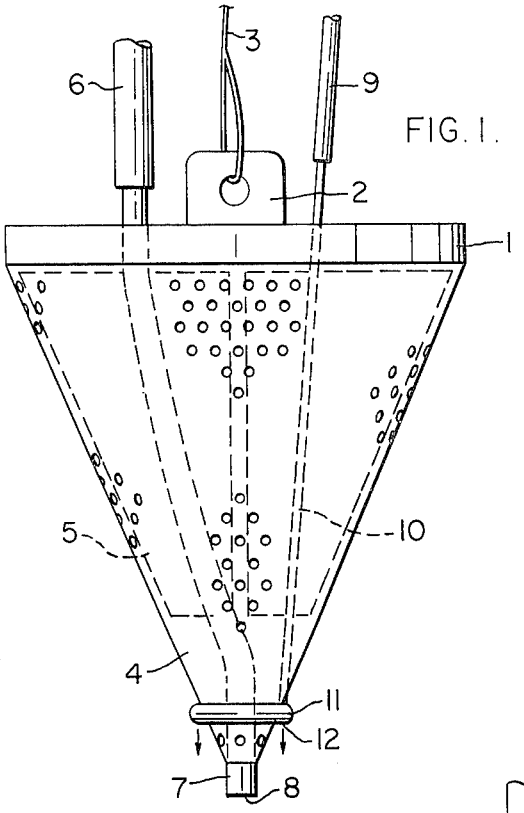
FIG. 1.
FIG. 2.
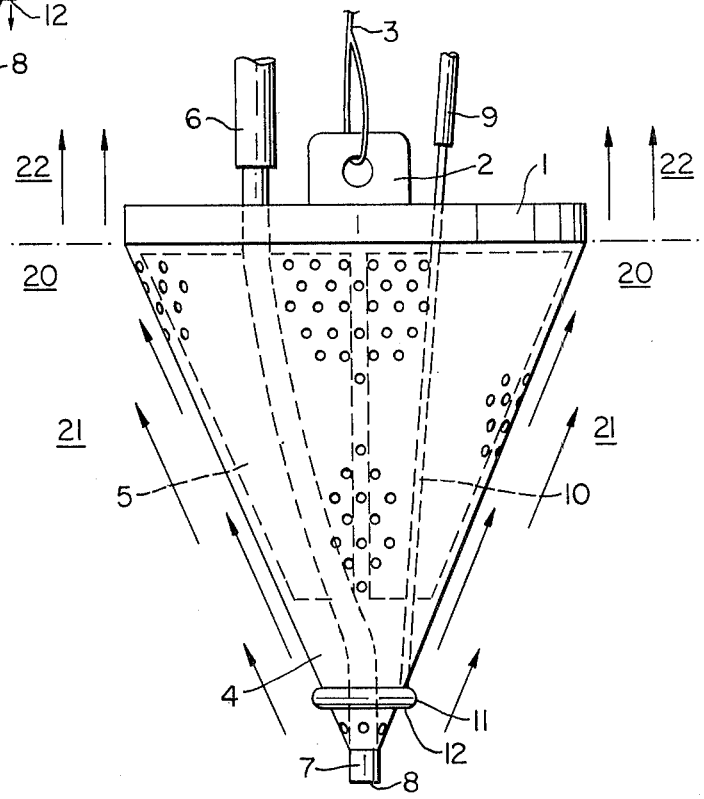

SELF-BURYING ANCHORING DEVICES

This invention relates to improvements in anchoring devices and in particular to so called self burying anchoring devices which provide an anchorage by embedding themselves into a bed material.

Co-pending UK Pat. No. 1481696 disclose a self-burying anchoring device which directs water jets to the zone beneath itself and uses a pumping system to transport fluidised bed material from below to above the device through a central duct. The burial depth of such devices is limited by the length of the central duct, and attachment of a mooring hawser to this anchoring device is complicated by the central duct.

An object of the present invention is to provide a self-burying anchoring device of very simple and cheap construction so as to be expendable, which has extremely high holding power compared to its own weight and which is self-burying both in the seabed and in dry land in bed materials which can be fluidized.

The present invention provides a self-burying anchoring device comprising an anchor plate having means for the attachment of a mooring hawser, or the like, an anchor body dependent from the anchor plate and tapering to an apex thereof, a liquid supply means having an outlet to the exterior of the anchor body and at or adjacent the apex externally of the anchor body, and a gas supply means having at least one outlet to the exterior of the anchor body and near to but above the liquid supply outlet.

Preferably the liquid supply means is a passageway terminating in an open ended tube protruding from the apex of the anchor body. Conveniently the liquid is water. The gas supply means preferably comprises a passageway terminating in a plurality of open ended tubes or in a distribution ring having circumferentially distributed outlets. Conveniently compressed air is used.

The flow of fluidizing liquid in conjunction with the expansion of the compressed gases within the confines of undisturbed bed material establishes an upward movement of the fluidised bed material which buries the anchoring device.

The anchor body is preferably in the form of a circular cone in which the half-cone angle is less than the angle of repose of the bed material into which the anchoring device is to be buried. The slant surface of the cone structure may with advantage be perforated to reduce the weight of the anchoring device before use although during operation the space within the cone structure will become filled with solid bed material thereby increasing the weight of the anchoring device and assisting in its burial.

The anchor plate of the anchoring device is the main load bearing member and is designed to accept the maximum structural loading placed on the anchoring device. A central attachment eye is provided on the load plate member for attachment of a mooring hawser.

Since the anchoring device of the invention is expendable the hoses supplying water and air respectively to the first and second fluid supply passageways may incorporate break couplings so positioned in the supply hoses that when the anchoring device has attained its designed depth part at least of the supply hoses might be salvaged for re-use.

Stabilizing of the anchoring device during its initial penetration of the bed material may be provided by means of a guide cylinder having a large flanged base and within which the anchoring device might be loosely and slideably located. The guide cylinder may be retrieved once burial of the anchoring device into the bed material has passed the initial stage.

An embodiment of the present invention will now be described by way of example only and with reference to the accompanying drawings in which:

FIG. 1 is a side elevation of an anchoring device of the invention,

FIG. 2 shows the anchoring device of FIG. 1 passing through the bed material,

Figure 3:
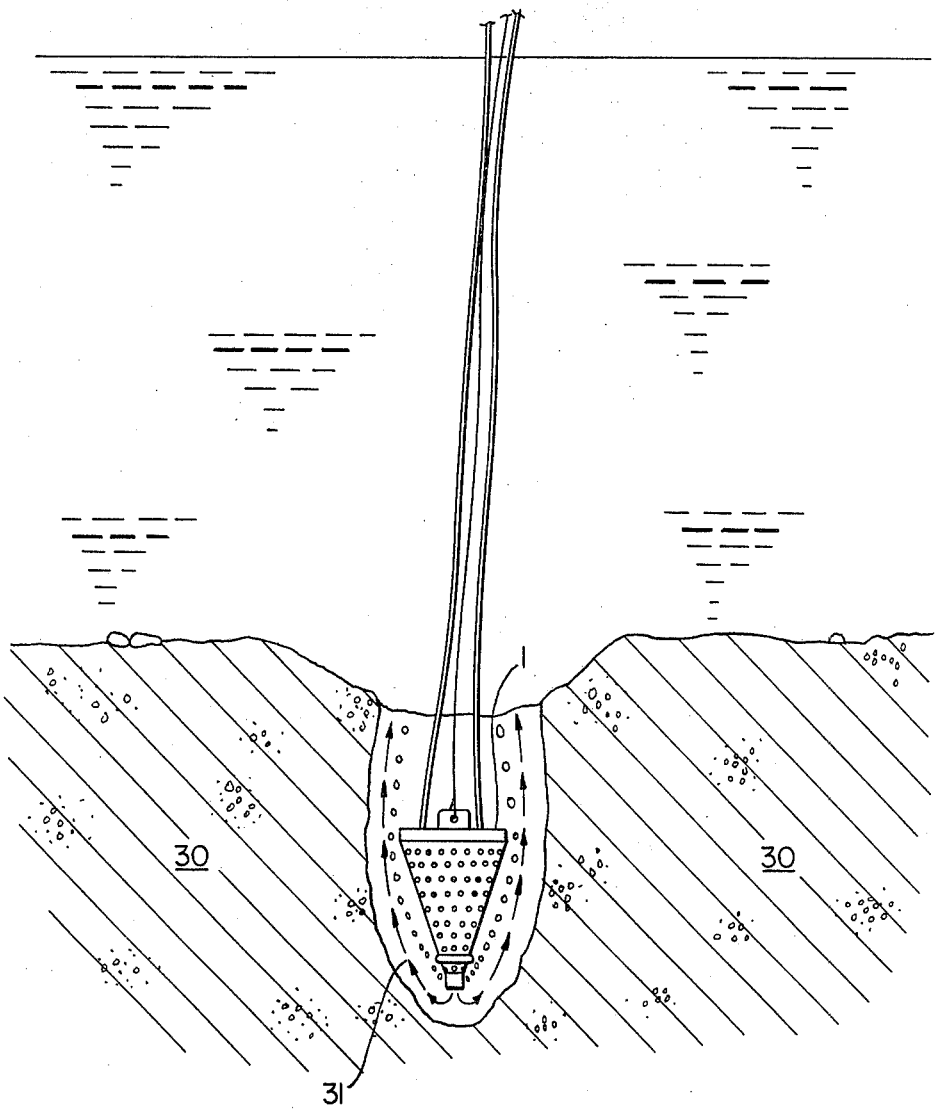
FIG. 3 is a diagrammatic representation of the anchoring device of FIG. 1 in the initial stages of its burial.

Referring to FIG. 1 the anchoring device comprises an anchor plate 1 having a central attachment eye 2 for attachment of a mooring hawser 3. Depending from the lower surface of the anchor plate 1 there is provided an anchor body comprising an inverted cone structure 4 which is strengthened by internal rib plates 5.

A flexible water hose 6 connects with a water supply passageway 7 in the form of a rigid pipe which passes through the body of the anchoring device to protrude through the apex region of the cone structure 4 where it terminates in an outlet 8. Similarly a flexible air hose 9 connects with an air supply passageway 10 which passes through the body of the anchoring device before terminating in an air distribution ring 11 positioned outside of the cone structure 4 just above its apex region. The air distribution ring 11 is provided with a series of circumferentially spaced apart jets 12.

The cone structure 4 is fabricated for lightness from perforated metal or alloy plate although it might just as conveniently be fabricated from solid metal plate. When fabricated from solid plate the interior might with advantage be filled with concrete, rubble or other ballast to increase the weight of the anchoring device and assist in its burial.

FIG. 2 shows diagrammatically the general principle on which the anchoring device operates. The anchoring device is shown passing through bed material 20 which may be considered in two zones, a lower zone 21 laterally adjacent the cone structure 4 and an upper zone 22 laterally adjacent and above the anchor plate 1. For downward movement of the anchoring device in a porous granular bed material it is necessry to move the solid particles surrounding the anchoring device in particular directions. In zone 21 for example a vertical and horizontal outward displacement is required whilst in zone 22 a vertical movement only is required.

To facilitate the necessary particle movement in zone 21 it is important that the half-cone angle (half the included angle at the cone apex) is less than the natural angle of repose of the bed material (ie the angle formed between the horizontal and the sloping side of the natural conical depression which would be formed in the bed material when subjected to localised suction or blowing).

FIG. 3 shows the anchoring device of FIG. 1 partially buried in a seabed material. The undisturbed solids of the seabed material are indicated at 30 whilst the disturbed solid region, constituting the zones 21 and 22 of FIG. 2, is shown generally at 31.

The operation of the anchoring device will now be described with reference to FIGS. 1, 2 and 3. Water is supplied under pressure via the hose 6 and passageway 7 to the outlet 8 and compressed air is fed via the hose 9 passageway 10 to the air distribution ring 11. The introduction of water to the seabed material immediately beneath the anchoring device fluidizes the bed material and encourages a general upward movement. The simultaneous introduction of compressed air by the distribution ring 11 assists the water jet from the outlet 8 and induces it to turn and flow upwards and outwards along the slant surface of the cone structure 4 through zone 21 and vertically upwards through zone 22. The air rising upwards through the solids/water mixture expands nearly isothermally and results in an air-lift pumping system operating within the constraining wall of the relatively impermeable surrounding undisturbed solid bed material 30. As the anchoring device settles into the bed material under its own weight the cone structure 4 will gradually become filled with bed material through the perforations in its plate wall.

Figure 4:
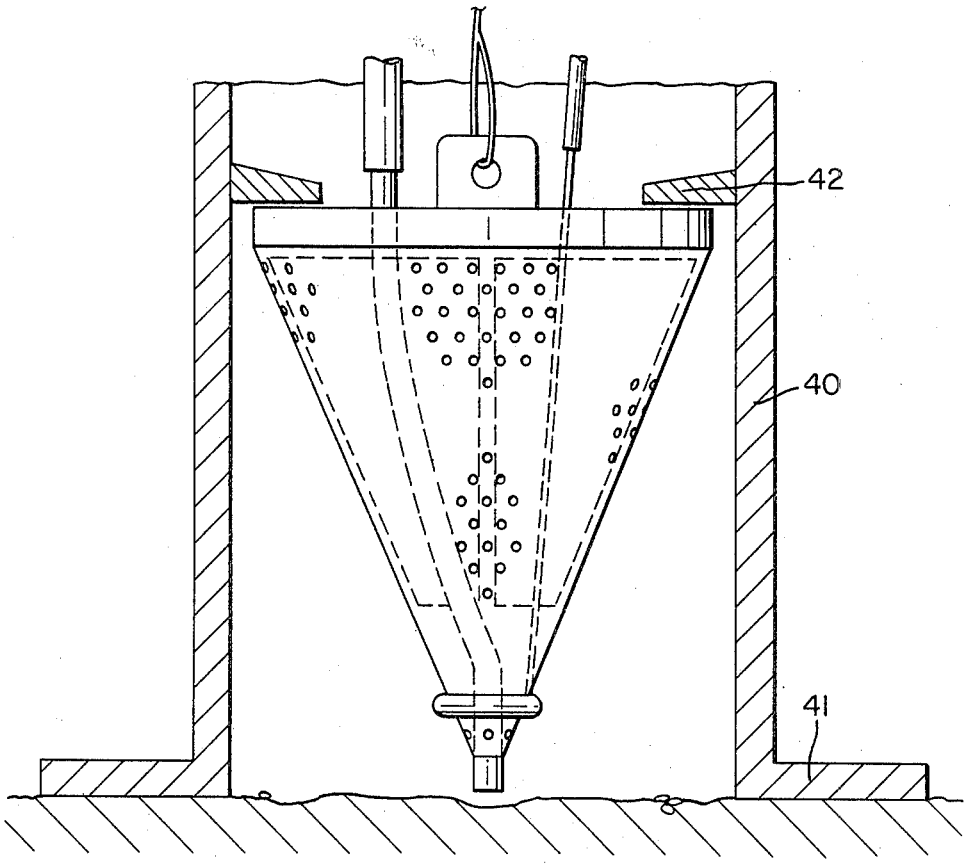
FIG. 4 shows the anchoring device of FIG. 1 positioned within a stabilising guide cylinder immediately prior to use.

FIG. 4 shows a stabilising guide cylinder which might be used in the initial stages of burial. The cylinder comprises a tubular member 40 having a large flange portion 41 which in use sits in the surface of the bed material. The tube member 40 is of such a diameter that the anchoring device may slide freely within it whilst at the same time being constrained from straying too far from the vertical. Short inwardly directed radial flange members 42 might be provided immediately above the anchoring device by which the guide cylinder is supported on the anchor plate 1 of the anchoring device whilst it is being lowered on to the bed material. The use of the guide cylinder of FIG. 4 is particularly desirable when the anchoring device is being sunk into dry land; an added advantage being that loose lying bed material in the early stages of sinking is contained within the general confines of the guide cylinder.

The flexible water and air hoses 6 and 9 are no longer required after burial is achieved and they might conveniently be retrieved by operation of break couplings (not shown) positioned in the hoses at a point known to be above the bed material level when the anchoring device has achieved its intended depth of burial.

The actual depth of burial of the anchoring device depends upon the pressure of the water supply via the flexible hose 6, passageway 7 and outlet 8 being sufficient to overcome the total resistance of the fluid circuit, ie the frictional resistance of the tubing, the loss of velocity head at exit from the outlet 8 and the total resistance of the over-burden of solids/liquid/air plus the velocity head loss at seabed level.

In a preliminary trial a 2 foot diameter anchoring device made in accordance with FIG. 1 has been successfully buried in a sand seabed. A burial depth of 12 feet was achieved in 12 minutes and a steady vertical pull-out force of 17 tons was required to pull the anchoring device free of the seabed.

I claim:

1. A self burying anchoring device for providing an anchorage in a bed of material, comprising an anchor plate, an anchor body dependent from the anchor plate and tapering to an apex thereof, a liquid supply means, at least one liquid discharge outlet to the exterior of the anchor body for said liquid supply means and situated at said apex, a gas supply means, and at least one gas discharge outlet to the exterior of the anchor body for said gas supply means and situated near to but above said liquid discharge outlet:

whereby in use thereof, a forced liquid flow through the liquid discharge outlet from the liquid supply means, and a flow of compressed gas through the gas discharge outlet from the gas supply means, causes bed material to travel upwardly along the exterior of the anchoring device to bury same.

2. A self burying anchoring device as claimed in claim 1 in which the anchor body is in the form of an inverted cone having a half cone angle less than the angle of repose of the bed material.

3. A self burying anchoring device as claimed in claim 1 in which the anchor body is hollow.

4. A self burying anchoring device as claimed in claim 3 in which the anchor body is of perforated material and such that in use thereof bed material is swept into the hollow anchor body through the perforations.

5. A self burying anchoring device as claimed in claim 1 in which the liquid supply means comprises a single passage through the anchor body leading to a liquid discharge outlet.

6. A self burying anchoring device as claimed in claim 1 in which the gas supply means comprises a single passage through the anchor body leading to a gas distribution ring, the device having a plurality of said gas discharge outlets circumferentially spaced upon a gas distribution ring.

7. A self burying anchoring device for providing an anchorage in a bed of material, comprising an anchor plate, a mooring line attachment means for the anchor plate, a hollow anchor body dependent from the anchor plate and in the form of a hollow inverted cone of perforated material, a liquid supply passage through the anchor body, a liquid discharge outlet to the exterior of the anchor body in the form of an open ended tube terminating the liquid supply passage at the apex of the anchor body, a gas supply passage through the anchor body, a gas distribution ring terminating the gas supply passage and near to but above the apex of the anchor body, and a plurality of gas discharge outlets circumferentially spaced on the distribution ring:

whereby in use thereof, a forced liquid flow through the liquid discharge outlet from the liquid supply passage, and a flow of compressed gas through the gas discharge outlets from the gas distribution ring causes bed material to travel upwardly along the exterior of the anchoring device, to bury same.

8. A self burying anchoring device as claimed in claim 7 including break couplings in the liquid supply and gas supply passages.

* * * * *